US010502477B2

(12) United States Patent
Miller et al.

(10) Patent No.: US 10,502,477 B2
(45) Date of Patent: Dec. 10, 2019

(54) REFRIGERATOR APPLIANCE

(71) Applicant: General Electric Company, Schenectady, NY (US)

(72) Inventors: Charles Benjamin Miller, Louisville, KY (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1046 days.

(21) Appl. No.: 14/341,988

(22) Filed: Jul. 28, 2014

(65) Prior Publication Data

US 2016/0025399 A1 Jan. 28, 2016

(51) Int. Cl.
*F25D 21/14* (2006.01)

(52) U.S. Cl.
CPC ..... *F25D 21/14* (2013.01); *F25C 2400/10* (2013.01)

(58) Field of Classification Search
CPC ..... F25D 21/14; F25D 23/02; F25D 23/028; F25D 23/061
See application file for complete search history.

(56) References Cited

U.S. PATENT DOCUMENTS 3,995,636 A 12/1976 Murray et al.
4,497,707 A 2/1985 Anderson
4,521,309 A 6/1985 Pall
4,619,677 A 10/1986 Matheson et al.
4,855,077 A 8/1989 Shikinami et al.
4,912,942 A * 4/1990 Katterhenry ..... F25D 23/028 403/71
5,089,144 A 2/1992 Ozkahyaoglu et al.
5,135,645 A 8/1992 Sklenak et al.
(Continued)

FOREIGN PATENT DOCUMENTS

CN 2514297 Y 10/2002
EP 1936305 A2 6/2008
(Continued)

OTHER PUBLICATIONS

PCT Search Report and Written Opinion PCT/US2014/056282, dated Nov. 27, 2014. (11 pages).
(Continued)

*Primary Examiner* — Ana M Vazquez
(74) *Attorney, Agent, or Firm* — Dority & Manning, P.A.

(57) ABSTRACT

Refrigerator appliances are provided. A refrigerator appliance includes a cabinet defining a fresh food chamber and a freezer chamber, and a door rotatably hinged to the cabinet for accessing the fresh food chamber. The door further defines an ice box. The refrigerator appliance further includes an ice maker disposed within the ice box, and a container defining a storage volume for receipt of ice produced by the ice maker. The refrigerator appliance further includes a drain assembly for draining melt water from the container. The drain assembly includes a male connector mounted to the door for flowing melt water therethrough, and a first duct providing fluid communication between the container and the male connector. The drain assembly further includes a female connector mounted within the fresh food chamber for flowing melt water therethrough from the male connector, and a second duct providing fluid communication from the female connector.

18 Claims, 9 Drawing Sheets

(56) References Cited

U.S. PATENT DOCUMENTS

| | | | |
|---|---|---|---|
| 5,171,430 | A | 12/1992 | Beach et al. |
| 5,190,666 | A | 3/1993 | Bisconte |
| 5,192,424 | A | 3/1993 | Beyne et al. |
| 5,328,597 | A | 7/1994 | Boldt, Jr. et al. |
| 5,536,264 | A | 7/1996 | Hsueh et al. |
| 5,907,958 | A | 6/1999 | Coates et al. |
| 6,009,404 | A | 12/1999 | Eimer |
| 6,051,144 | A | 4/2000 | Clack et al. |
| 6,139,738 | A | 10/2000 | Maxwell |
| 6,148,621 | A | 11/2000 | Byczynski et al. |
| 6,153,105 | A | 11/2000 | Tadlock et al. |
| 6,205,807 | B1 | 3/2001 | Broadbent |
| 6,303,031 | B1 | 10/2001 | Senner |
| 6,337,015 | B1 | 1/2002 | Poirier |
| 6,355,177 | B2 | 3/2002 | Senner et al. |
| 6,533,926 | B2 | 3/2003 | Hawkins et al. |
| 6,537,444 | B2 | 3/2003 | Wilberscheid et al. |
| 6,551,503 | B2 | 4/2003 | Niers et al. |
| 6,708,518 | B1 | 3/2004 | Jones et al. |
| 6,753,783 | B2 | 6/2004 | Friedman et al. |
| 6,865,941 | B2 | 3/2005 | Gibbs |
| 6,950,032 | B1 | 9/2005 | Hewitt et al. |
| 7,062,936 | B2 | 6/2006 | Rand et al. |
| 7,067,054 | B2 | 6/2006 | Fritze |
| RE39,361 | E | 10/2006 | Den Dekker |
| 7,481,917 | B2 | 1/2009 | Ikeyama et al. |
| 7,638,042 | B2 | 12/2009 | Astle et al. |
| 7,736,495 | B2 | 6/2010 | Ikeyama et al. |
| 7,836,708 | B2 | 11/2010 | Krause et al. |
| 7,874,457 | B2 | 1/2011 | Sowers et al. |
| 8,025,186 | B2 | 9/2011 | Lee et al. |
| 8,057,669 | B2 | 11/2011 | Beard et al. |
| 8,118,997 | B2 | 2/2012 | Ebrom et al. |
| 8,196,809 | B2 | 6/2012 | Thorstensson |
| 8,216,463 | B1 | 7/2012 | Baird |
| 8,240,159 | B2 | 8/2012 | Prabhakar et al. |
| 8,242,893 | B1 | 8/2012 | Lin |
| 8,282,820 | B2 | 10/2012 | Cur et al. |
| 8,289,173 | B2 | 10/2012 | Ben-Mansour et al. |
| 8,459,047 | B2 | 6/2013 | Hall et al. |
| 8,544,291 | B2 | 10/2013 | Kim et al. |
| 8,695,371 | B2 | 4/2014 | Boarman et al. |
| 8,746,003 | B2 | 6/2014 | Yoon |
| 8,844,314 | B2 | 9/2014 | Bortoletto et al. |
| 8,950,197 | B2 | 2/2015 | Bortoletto et al. |
| 9,046,299 | B2 | 6/2015 | An et al. |
| 9,074,802 | B2 | 7/2015 | Culley et al. |
| 9,074,803 | B2 | 7/2015 | Culley |
| 9,080,800 | B2 | 7/2015 | Culley |
| 9,151,527 | B2 | 10/2015 | Boarman et al. |
| 9,273,890 | B2 | 3/2016 | Bortoletto et al. |
| 9,303,903 | B2 | 4/2016 | Boarman et al. |
| 9,506,682 | B2 * | 11/2016 | Yun ..... F25D 23/126 |
| 10,072,888 | B2 | 9/2018 | Jeong et al. |
| 2002/0189983 | A1 | 12/2002 | Guess et al. |
| 2004/0001991 | A1 | 1/2004 | Kinkelaar et al. |
| 2004/0007516 | A1 | 1/2004 | Fritze et al. |
| 2004/0025527 | A1 | 2/2004 | Takahashi et al. |
| 2004/0251210 | A1 | 12/2004 | Fritze et al. |
| 2005/0092070 | A1 | 5/2005 | Bhatti |
| 2005/0167352 | A1 | 8/2005 | Burrows et al. |
| 2005/0194317 | A1 | 9/2005 | Ikeyama et al. |
| 2005/0263457 | A1 | 12/2005 | Wilkins et al. |
| 2006/0011523 | A1 | 1/2006 | Schrott et al. |
| 2006/0060512 | A1 | 3/2006 | Astle et al. |
| 2006/0186031 | A1 | 8/2006 | Fick et al. |
| 2008/0034761 | A1 | 2/2008 | Hartley |
| 2008/0055112 | A1 | 3/2008 | McGinty et al. |
| 2009/0046715 | A1 | 2/2009 | McCoy |
| 2009/0134074 | A1 | 5/2009 | Doran |
| 2009/0293508 | A1 | 12/2009 | Rafalovich et al. |
| 2010/0100026 | A1 | 4/2010 | Morris |
| 2010/0218540 | A1 | 9/2010 | McCollough et al. |
| 2010/0275633 | A1 | 11/2010 | An et al. |
| 2011/0036109 | A1 | 2/2011 | Krause et al. |
| 2011/0036782 | A1 | 2/2011 | DiLeo |
| 2011/0062060 | A1 | 3/2011 | Royal et al. |
| 2011/0126576 | A1 | 6/2011 | Jeong et al. |
| 2011/0209483 | A1 | 9/2011 | Hall et al. |
| 2012/0118001 | A1 | 5/2012 | Mitchell |
| 2012/0130330 | A1 | 5/2012 | Wilson et al. |
| 2012/0297817 | A1 | 11/2012 | Krause et al. |
| 2012/0324913 | A1 | 12/2012 | Bortoletto et al. |
| 2012/0324914 | A1 | 12/2012 | Bortoletto et al. |
| 2013/0008838 | A1 | 1/2013 | Burke et al. |
| 2013/0068673 | A1 | 3/2013 | Maggiore et al. |
| 2013/0240431 | A1 | 9/2013 | Foix et al. |
| 2014/0018727 | A1 | 1/2014 | Burbank et al. |
| 2014/0110331 | A1 | 4/2014 | Baird |
| 2014/0158638 | A1 | 6/2014 | Caulkins et al. |
| 2014/0200538 | A1 | 7/2014 | Euliano et al. |
| 2014/0305930 | A1 | 10/2014 | Heizer et al. |
| 2014/0353235 | A1 | 12/2014 | Sherman et al. |
| 2015/0101669 | A1 | 4/2015 | Kraus et al. |
| 2015/0102931 | A1 | 4/2015 | Chernov et al. |
| 2015/0135758 | A1 | 5/2015 | Miller |
| 2015/0192338 | A1 | 7/2015 | Knatt |
| 2015/0290567 | A1 | 10/2015 | Chernov et al. |
| 2015/0290568 | A1 | 10/2015 | Chernov et al. |
| 2015/0290569 | A1 | 10/2015 | Chernov et al. |
| 2016/0025406 | A1 | 1/2016 | An |

FOREIGN PATENT DOCUMENTS

| | | | |
|---|---|---|---|
| JP | 03191748 | A | 8/1991 |
| JP | 2001016025 | A | 1/2001 |
| JP | 2003192096 | A | 7/2003 |
| JP | 3665260 | B2 | 6/2005 |
| JP | 2006258684 | A | 9/2006 |
| JP | 2007147356 | A | 6/2007 |
| JP | 2007163255 | A | 6/2007 |
| KR | 20120120844 | A | 11/2012 |
| WO | WO 83/02523 | A1 | 7/1983 |
| WO | WO 97/38272 | A1 | 10/1997 |
| WO | WO 03/011426 | A1 | 2/2003 |
| WO | WO 03/084875 | A1 | 10/2003 |
| WO | WO 2004/037383 | A1 | 5/2004 |
| WO | WO 2007068506 | A1 | 6/2007 |
| WO | WO 2008061179 | A2 | 5/2008 |
| WO | WO 2008/125530 | A1 | 10/2008 |

OTHER PUBLICATIONS

PCT Search Report and Written Opinion PCT/US2014/060223, dated Jan. 23, 2015. (9 pages).

* cited by examiner

REFRIGERATOR APPLIANCE

FIELD OF THE INVENTION

The present subject matter relates generally to refrigerator appliances, and more particularly to drain assemblies for draining melt water from ice maker assemblies of refrigerator appliances.

BACKGROUND OF THE INVENTION

Refrigerator appliances generally include a cabinet that defines a chilled chamber for receipt of food items for storage. In particular, the cabinet can define a fresh food chamber and a freezer chamber. The fresh food chamber can be maintained at a temperature greater than the freezing point of water. Conversely, the freezer chamber can be maintained at a temperature equal to or less than the freezing point of water.

Certain refrigerator appliances also include an ice maker for producing ice. The ice maker can be positioned within the appliances' freezer chamber and direct ice into an ice bucket where it can be stored within the freezer chamber. Such refrigerator appliances can also include a dispensing system for assisting a user with accessing ice produced by the refrigerator appliances' ice maker. Storing ice within a refrigerator appliance's freezer chamber can have certain drawbacks. In particular, certain refrigerator appliances maintain their freezer chambers at temperatures well below the freezing point of water. Ice stored in such conditions can become cloudy and/or hard relative to ice stored at warmer temperatures. Consumers can find such cloudy and/or hard ice undesirable.

As such, a current trend that is increasing in popularity is the desire for "nugget", or chewable, ice. Such ice is typically stored at a relatively higher than normal temperature such as above 32 degrees Fahrenheit in some cases. For example, such ice may be formed and stored generally within the fresh food chamber, such as in an ice box defined in the door for accessing the fresh food chamber. However, nugget ice has disadvantages. For example, such ice when stored in a container will melt. The melt water may cause the ice to stick together and lead to other undesirable results.

Accordingly, improved refrigerator appliances are desired in the art. In particular, refrigerator appliances which provide improved drainage for melt water would be advantageous.

BRIEF DESCRIPTION OF THE INVENTION

Aspects and advantages of the invention will be set forth in part in the following description, or may be apparent from the description, or may be learned through practice of the invention.

In accordance with one embodiment, a refrigerator appliance is provided. The refrigerator appliance includes a cabinet defining a fresh food chamber and a freezer chamber, and a door rotatably hinged to the cabinet for accessing the fresh food chamber, the door comprising an inner surface and an outer surface and rotatable between an open position and a closed position. The door further defines an ice box. The refrigerator appliance further includes an ice maker disposed within the ice box, and a container defining a storage volume for receipt of ice produced by the ice maker. The refrigerator appliance further includes a drain assembly for draining melt water from the container. The drain assembly includes a male connector mounted to the door for flowing melt water therethrough, and a first duct providing fluid communication between the container and the male connector. The drain assembly further includes a female connector mounted within the fresh food chamber for flowing melt water therethrough from the male connector, and a second duct providing fluid communication from the female connector.

In accordance with another embodiment, a refrigerator appliance is provided. The refrigerator appliance includes a cabinet defining a fresh food chamber and a freezer chamber, and a door rotatably hinged to the cabinet for accessing the fresh food chamber, the door comprising an inner surface and an outer surface and rotatable between an open position and a closed position. The door further defines an ice box. The refrigerator appliance further includes an ice maker disposed within the ice box, and a container defining a storage volume for receipt of ice produced by the ice maker, the container removably positioned within the ice box. The refrigerator appliance further includes an evaporator pan, and a drain assembly for draining melt water from the container. The drain assembly includes a check valve mounted to the door for flowing melt water therethrough, and a first duct providing fluid communication between the container and the check valve. The drain assembly further includes a receiver cup mounted within the fresh food chamber for flowing melt water therethrough from the check valve, and a second duct providing fluid communication between the receiver cup and the evaporator pan. The check valve allows the flow of melt water therethrough when the door is in the closed position and prevents the flow of melt water therethrough when the door is in the open position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
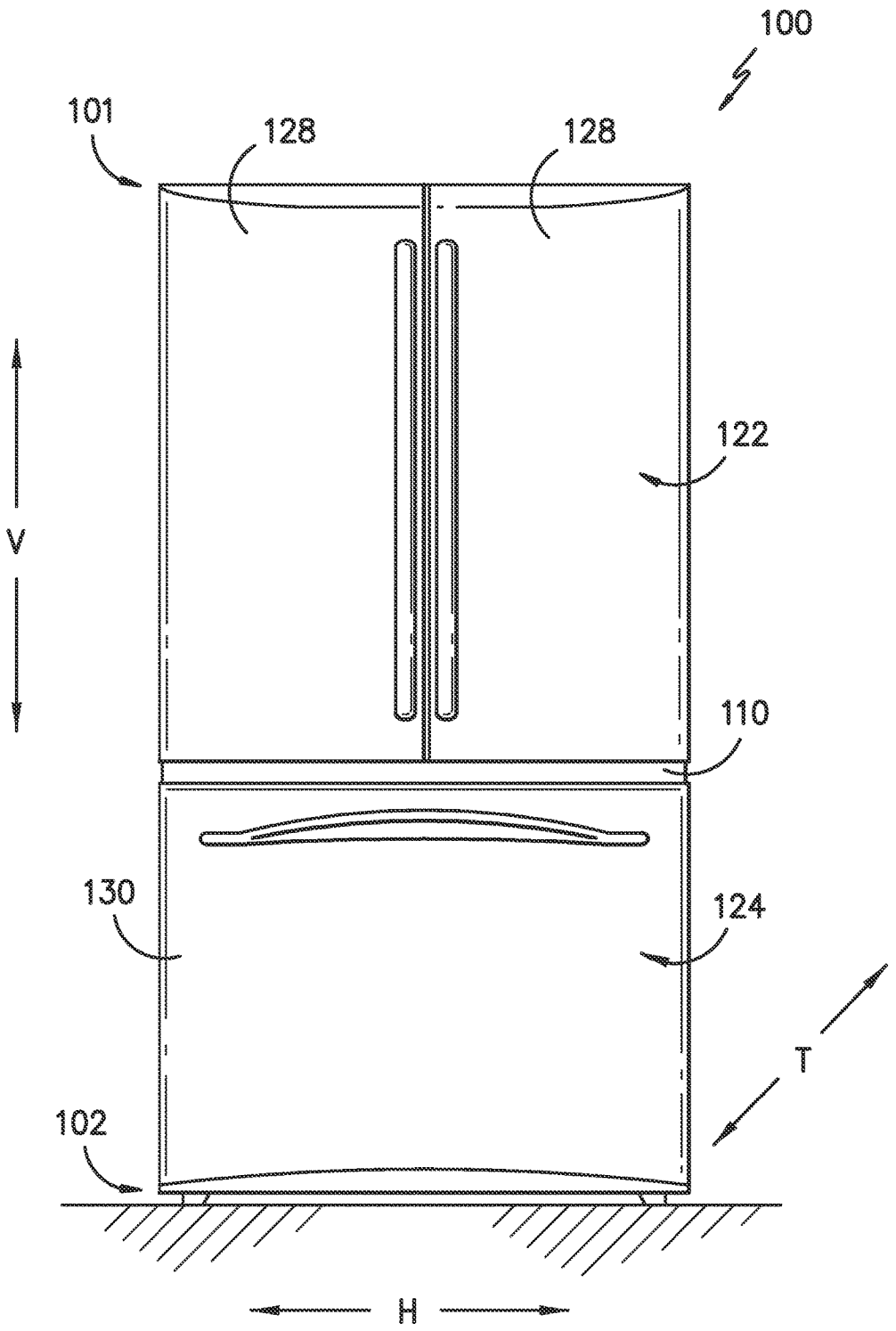
FIG. 1 provides a front, elevation view of a refrigerator appliance with doors in closed positions in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
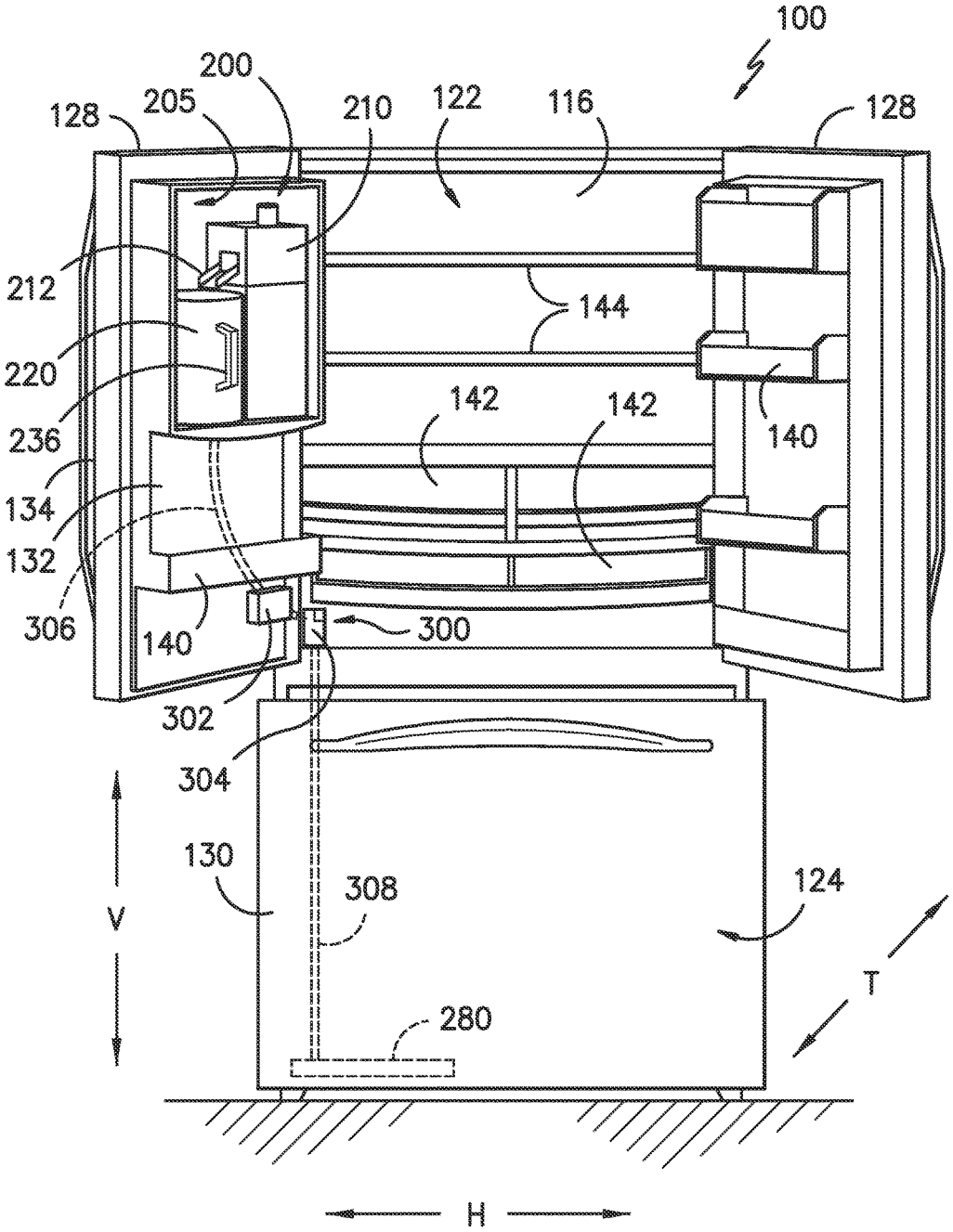
FIG. 2 provides a front, elevation view of the refrigerator appliance of FIG. 1 with doors of the refrigerator appliance shown in open positions to reveal a fresh food chamber of the refrigerator appliance and an ice-making assembly and drain assembly in accordance with one embodiment of the present disclosure.

FIG. 1 provides a front, elevation view of a refrigerator appliance 100 according to an exemplary embodiment of the present subject matter with refrigerator doors 128 of the refrigerator appliance 100 shown in a closed position. FIG. 2 provides a front, elevation view of refrigerator appliance 100 with refrigerator doors 128 shown in an open position to reveal a fresh food chamber 122 of refrigerator appliance 100. As discussed in greater detail below, refrigerator appliance 100 includes an ice-making assembly 200, e.g., positioned, when the doors 128 are in closed positions, generally within fresh food chamber 122 of refrigerator appliance 100.

Refrigerator appliance 100 includes a cabinet or housing 110 that extends between a top portion 101 and a bottom portion 102 along a vertical direction V. Cabinet 110 defines chilled chambers for receipt of food items for storage. In particular, cabinet 110 defines fresh food chamber 122 positioned at or adjacent top portion 101 of cabinet 110 and a freezer chamber 124 arranged at or adjacent bottom portion 102 of cabinet 110. Fresh food chamber 122 is thus in these embodiments disposed above freezer chamber 124 along the vertical direction V. As such, refrigerator appliance 100 is generally referred to as a bottom mount refrigerator appliance. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

In exemplary embodiments as illustrated, cabinet 110 includes a first sidewall 112 and a second sidewall (not shown), which are generally spaced apart along a horizontal direction H. Further, cabinet 110 may include a rear wall 116, which may be generally spaced apart from refrigerator door(s) 128 and freezer door(s) 130 of the refrigerator appliance 100 generally along a transverse direction T. The vertical, horizontal and transverse directions V, H, T may each be perpendicular to each other. Sidewalls 112 and rear wall 116 of cabinet 110 may define the fresh food chamber 122 and freezer chamber 124.

One or more refrigerator doors 128 are rotatably mounted or hinged to an edge of cabinet 110 for selectively accessing fresh food chamber 122. Each door 128 may include an inner surface 132 and an outer surface 134, between which the door 128 is generally defined. In addition, one or more freezer doors 130 are arranged below refrigerator doors 128 for selectively accessing freezer chamber 124. Freezer door 130 is coupled to a freezer drawer (not shown) slidably mounted within freezer chamber 124. As discussed above, refrigerator doors 128 and freezer door 130 are shown in the closed position in FIG. 1, and refrigerator doors 128 are shown in the open position in FIG. 2.

Turning now to FIG. 2, various storage components are mounted within fresh food chamber 122 to facilitate storage of food items therein as will be understood by those skilled in the art. In particular, the storage components include drawers 142 and racks 144 that are mounted within fresh food chamber 122. Bins 140 may additionally be provided, such as mounted on doors 128, and may be disposed within fresh food chamber 122 when the doors 128 are in the closed position. Bins 140, drawers 142, and racks 144 are configured for receipt of food items (e.g., beverages and/or solid food items) and may assist with organizing such food items. As an example, drawers 142 can receive fresh food items (e.g., vegetables, fruits, and/or cheeses) and increase the useful life of such fresh food items.

As may be seen in FIG. 2, an ice-making assembly 200 according to an exemplary embodiment of the present subject matter is mounted to refrigerator appliance 100. In particular, ice-making assembly 200 is mounted to one of refrigerator doors 128. Thus, ice-making assembly 200 can be positioned within fresh-food chamber 122, e.g., when refrigerator doors 128 are closed. Ice-making assembly 200 is configured for producing ice and is discussed in greater detail below.

Figure 3:
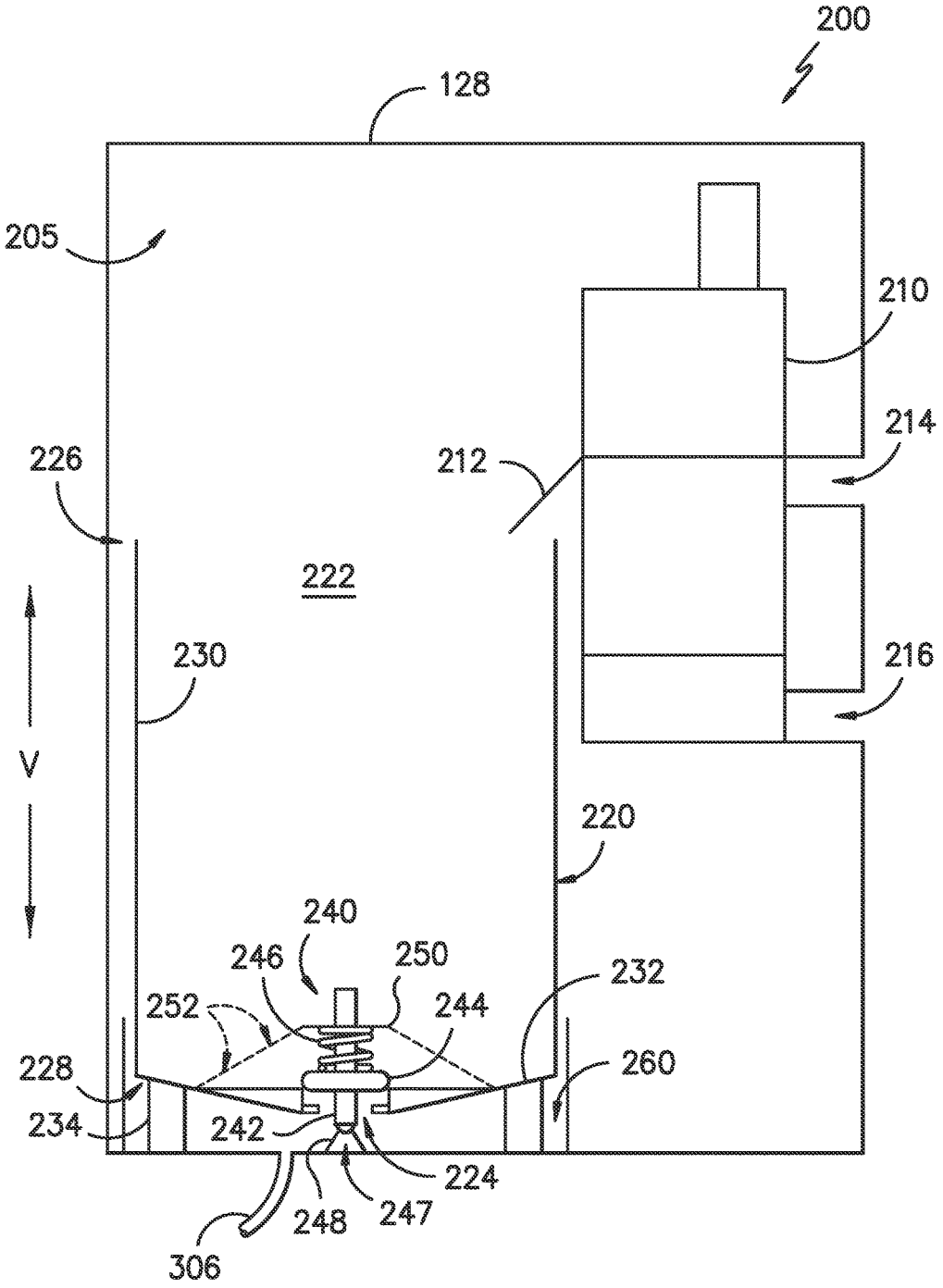
FIG. 3 provides a schematic view of an ice-making assembly in accordance with one embodiment of the present disclosure.
Figure 4:
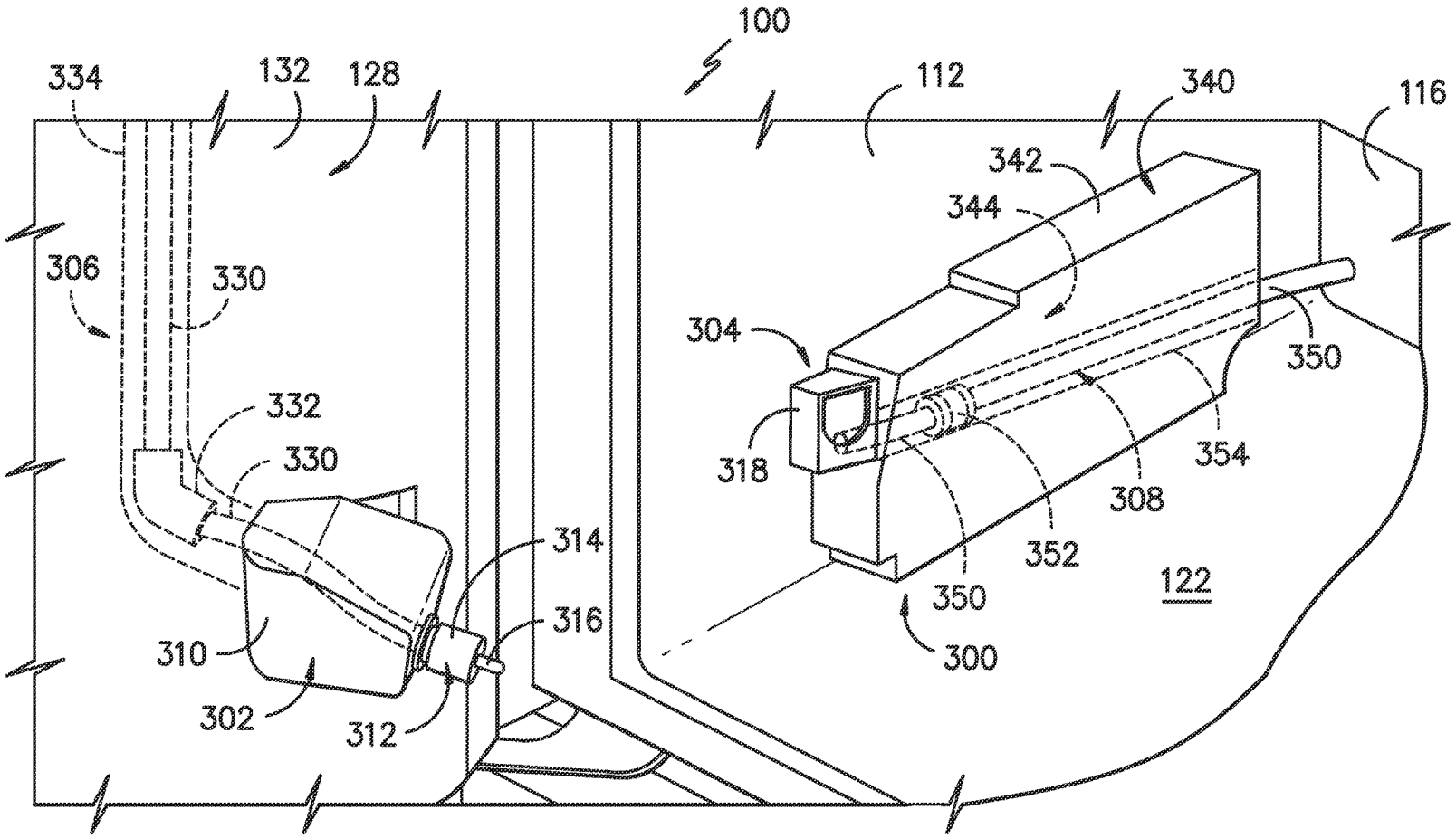
FIG. 4 provides a perspective view of a drain assembly in a refrigerator appliance with a door in an open position in accordance with one embodiment of the present disclosure.

FIG. 3 provides a schematic view of ice-making assembly 200. Ice-making assembly 200 generally includes an ice box 205, which is generally an area defined in one of the doors 128. Various components of the ice-making assembly 200, such as an ice maker 210 and a container 220, may be disposed within the ice box 205. Ice maker 210 is configured for producing ice. As an example, ice maker 210 can be a nugget or auger style ice maker. In the exemplary embodiment shown in FIG. 2, ice box 205 and ice maker 210 are positioned within fresh food chamber 122 when refrigerator doors 128 are closed. Ambient air within fresh food chamber 122 is not maintained at a sufficiently low temperature to permit formation of ice by ice maker 210. Thus, ice maker 210 includes a chilled air inlet 214 and a chilled air outlet 216. Chilled air inlet 214 can direct chilled air from freezer chamber 124 to ice maker 210. Because chilled air within freezer chamber 124 can have a sufficiently low temperature to permit formation of ice, chilled air therefrom can assist or permit ice maker 210 to produce ice despite the position of ice maker 210 within fresh food chamber 122. To facilitate the flow of chilled air from freezer chamber 124 to ice maker 210, chilled air outlet 216 can direct air away from ice maker 210, e.g., back to freezer chamber 124.

Ice maker 210 also includes an ice chute 212. Ice chute 212 directs ice produced by ice maker 210, e.g., into a storage volume 222 of container 220. Storage volume 222 is defined by container 220 and is configured for receipt of ice produced by ice maker 210. As may be seen in FIG. 2, ice maker 210 is positioned above container 220 along the vertical direction V. In particular, ice chute 212 of ice maker 210 is positioned above container 220 along the vertical direction V. Thus, ice can slide off of ice chute 212 and drop into storage volume 222 of container 220.

Container 220 is removably positioned or mounted within fresh food chamber 122 of housing 120 when door 128 is closed. In particular, container 220 can be removably positioned on or mounted to refrigerator door 128 within ice box 205. As an example, a user can grasp a handle 236 (FIG. 2) of container 220 in order to lift container 220 off of refrigerator door 128 and, e.g., place container 220 on a countertop or table such that the user can more easily access ice within storage volume 222 of container 220.

Container 220 extends between a top portion 226 and a bottom portion 228 along the vertical direction V. Ice from ice maker 210 can enter storage volume 222 of container 220 at top portion 226 of container 220 and rest within storage volume 222 of container 220 at bottom portion 228 of container 220. In particular, container 220 includes a bottom wall 232 positioned at bottom portion 228 of container 220. Ice within storage volume 222 of container 220 can rest on bottom wall 232. Container 220 also includes a sidewall 230 connected to bottom wall 232 and extending along the vertical direction V, e.g., between top and bottom portions 226 and 228 of container 220.

Because container 220 is positioned or stored within fresh food chamber 122, ice within storage volume 222 of container 220 may be maintained or stored at a temperature greater than the melting point of water or greater than about thirty-two degrees Fahrenheit. Thus, ice within storage volume 222 of container 220 melts over time. Such melting generates melt water run off within storage volume 222 of container 220. Accordingly, the present disclosure is further directed to features for directing such melt water out of storage volume 222 of container 220 as discussed in greater detail below.

In some embodiments, as illustrated in FIG. 3, a valve 240 is mounted to container 220, e.g., at bottom portion 228 of container 220. In particular, container 220 defines an opening 224 for permitting a flow of melt water out of storage volume 222 of container 220. Valve 240 is mounted at opening 224 and is configured for regulating the flow of water out of storage volume 222 of container 220 through opening 224.

Container 220 may also include a screen 250 positioned within storage volume 222 of container 220. Screen 250 can be mounted to bottom wall 232 of container 220, e.g., above valve 240 and opening 224 along the vertical direction V. Screen 250 defines a plurality of holes 252 that permit a flow of melt water therethrough. However, holes 252 are sized to hinder ice within storage volume 222 of container 220 from passing therethrough. Thus, screen 250 can support ice thereon while permitting melt water runoff to pass through holes 252 to opening 224 and out of storage volume 222 of container 220. In such a manner, screen 250 can hinder ice from clogging or obstructing opening 224 and/or valve 240.

Valve 240 includes a stem 242 mounted to container 220, e.g., to screen 250. Stem 242 can be a rod or other linear component that extends along the vertical direction V. A seal 244 is mounted to stem 242. Seal 244 can be constructed of any suitable material, such as an elastomeric material. Valve 240 also includes a biasing mechanism or spring 246. Spring 246 extends between container 220, e.g., screen 250 of container 220, and seal 244. Spring 246 urges seal 244, e.g., downwardly along the vertical direction V, against container 220 at opening 224 of container 220. In particular, spring 246 urges seal 244 into opening 224 of container 220 in order to clog or obstruct opening 224 and hinder the flow of melt water out of storage volume 222 of container 220 through opening 224.

As discussed above, valve 240 is configured for regulating the flow of melt water out storage volume 222 of container 220. In particular, valve 240 allows the flow of melt water out of storage volume 222 of container 220 through opening 224 when container 220 is positioned within ice box 205. Conversely, valve 240 prevents the flow of melt water out of storage volume 222 of container 220 through opening 224 when container 220 is removed ice box 205. Thus, valve 240 is configured for selective adjustment between an open position in which valve 240 allows the flow of melt water out storage volume 222 of container 220 and a closed position in which valve 240 prevents the flow of melt water out of storage volume 222 of container 220.

As may be seen in FIG. 3, valve 240 shifts between the open and closed positions when container 220 is removed from and inserted into fresh food chamber 122 of housing 120. In particular, valve 240 is in the open configuration when container 220 is positioned on refrigerator door 128 in ice box 205. Refrigerator door 128 includes an actuator 248, e.g., that extends upwardly along the vertical direction V. A distal end 247 of stem 242 can engage actuator 248 to slide stem 242 and seal 244 upwardly along the vertical direction V away from opening 224 when container 220 rests on refrigerator door 128.

From the position shown in FIG. 3, a user can utilize handle 236 (FIG. 2) of container 220 to lift container 220 off refrigerator door 128. When container 220 is removed from ice box 205 and/or positioned outside of fresh food chamber 122, distal end 247 of stem 242 does not engage actuator 248, and spring 246 urges stem 242 and seal 244 downwardly along the vertical direction V towards opening 224 such that seal 244 obstructs opening 224.

In such a manner, valve 240 can assist within regulating the flow of melt water through opening 224. In particular, valve 240 can permit runoff from melted ice to exit storage volume 222 of container 220 when container 220 is positioned on door 128, and valve 240 can obstruct opening 224 and hinder such runoff from spilling or leaking when container 220 is removed from door 128.

Refrigerator appliance 100 also includes a reservoir 260. Reservoir 260 is disposed below container 220 along the vertical direction V. In particular, support legs 234 of container 220 can rest within reservoir 260 when container 220 is positioned on refrigerator door 128. Reservoir 260 receives the flow of melt water from storage volume 222 of container 220, e.g., when valve 240 is in the open position and container 220 is mounted to refrigerator door 128.

It should be noted that a refrigerator appliance 100 and ice-making assembly 200 need not include a valve 240, etc. as disclosed herein. Any suitable components for facilitating the flow of melt water from container 220 into reservoir 260 or otherwise into a drain assembly as discussed herein are within the scope and spirit of the present disclosure. It should further be understood that the present disclosure is not limited to the above described ice-making assembly 200 embodiments. Any suitable ice-making assembly 200, include assemblies 200 which include components for dispensing ice through a door 128 of the appliance 100 and/or an assemblies 200 which include non-removable containers 220, are within the scope and spirit of the present disclosure.

Referring now to FIGS. 4 through 9, the present disclosure is further directed to a drain assembly 300 for draining melt water from the container 220. Drain assembly 300 generally includes a male connector 302 and a female connector 304 which may communicate to flow melt water therethrough. Additionally, a first duct 306 may flow melt water from the container 220 to the male connector 302, and a second duct 308 may flow melt water from the female connector 304 to an exhaust location, such as an evaporator pan 280 of the refrigerator appliance 100.

Figure 5:
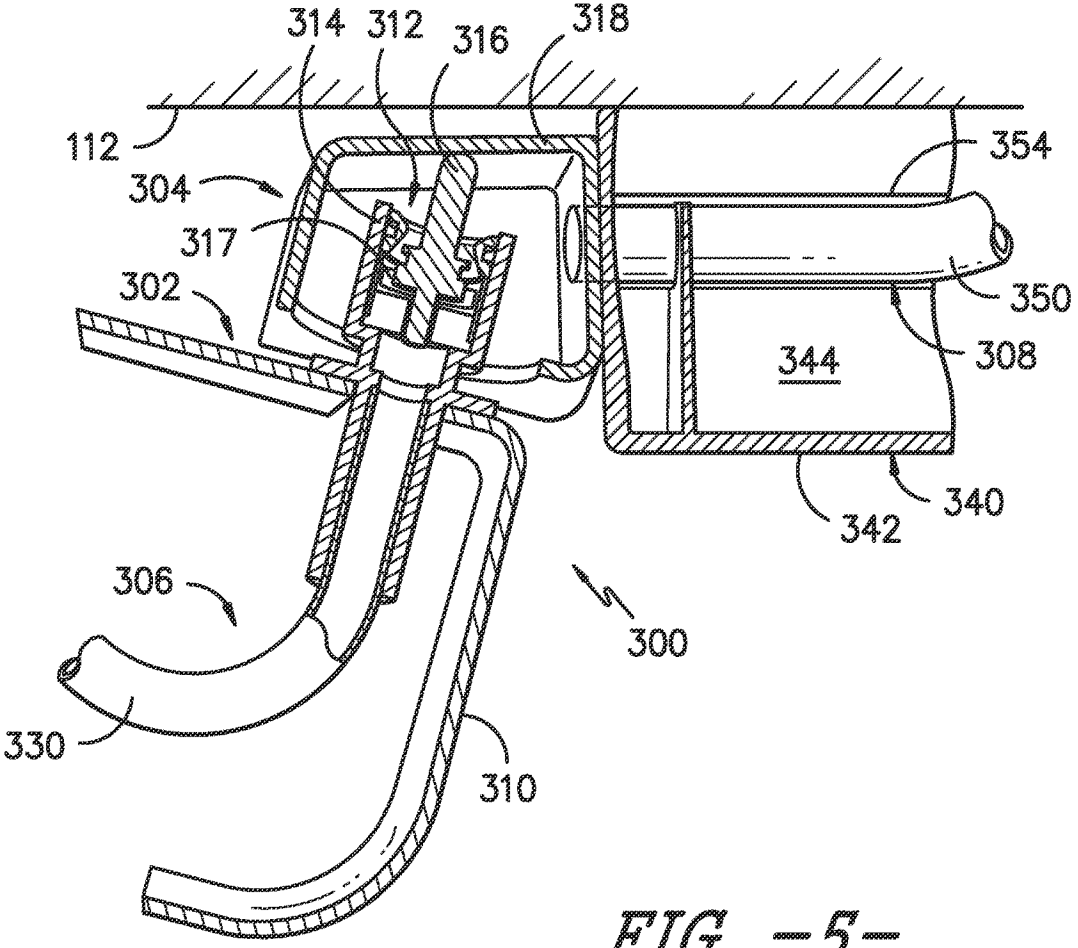
FIG. 5 is a top view of a drain assembly when a door is in a closed position in accordance with one embodiment of the present disclosure.
Figure 6:
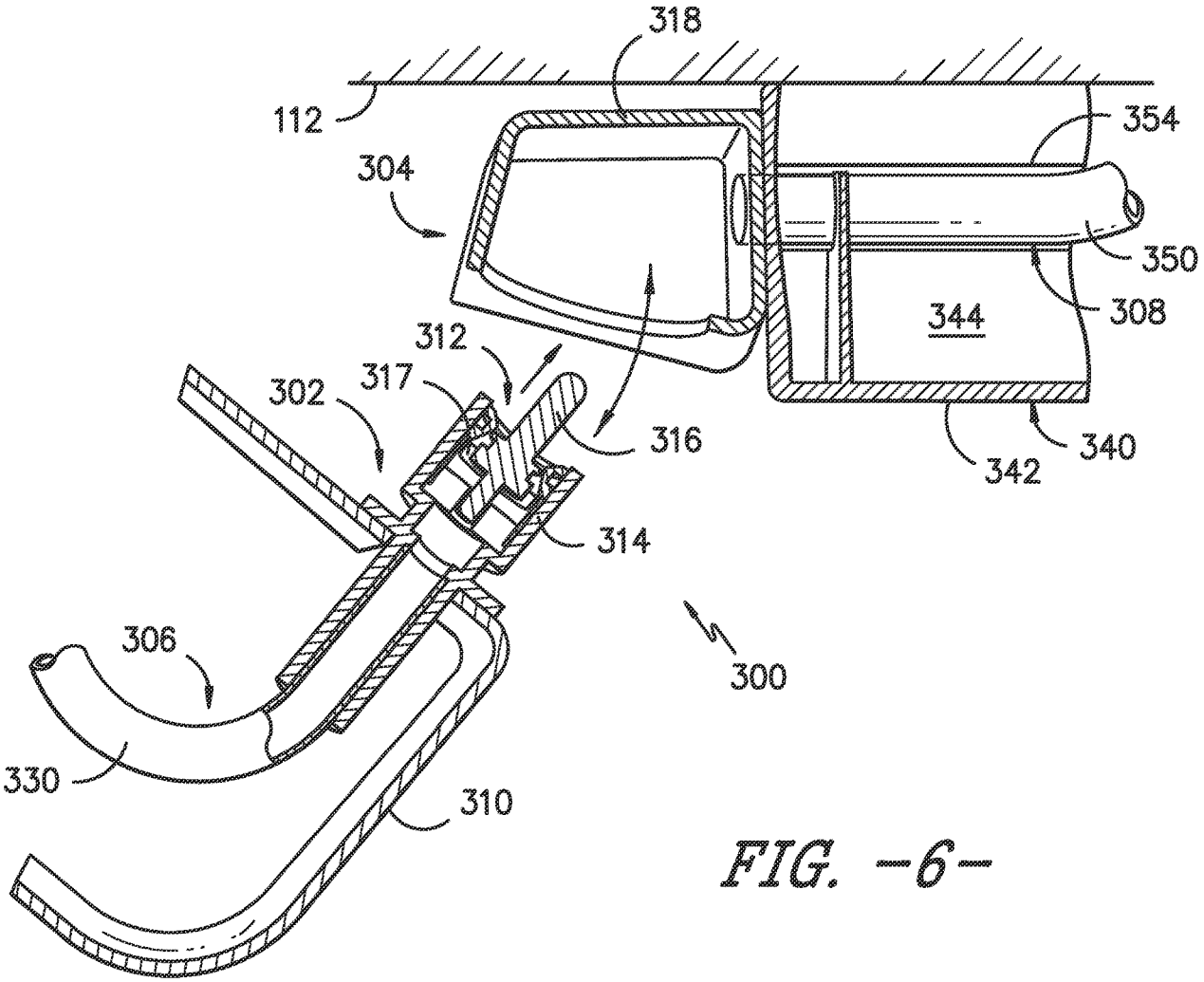
FIG. 6 is a top view of the drain assembly of FIG. 5 when a door is in an open position in accordance with one embodiment of the present disclosure.

In some embodiments, such as in the embodiments illustrated in FIGS. 4 through 6 and 9, the male connector 302 may allow the flow of melt water therethrough when the door 128 is in the closed position (as shown for example in FIG. 5) and prevent the flow of melt water therethrough when the door 128 is in the open position (as shown for example in FIG. 6). In other embodiments, such as in the embodiments illustrated in FIGS. 7 and 8, the male connector 302 may allow the flow of melt water therethrough when the door 128 is in the closed position (as shown for example in FIG. 7) and the open position (as shown for example in FIG. 8).

As illustrated, the male connector 302 may be mounted to a door 128. Further, the female connector 304 may be mounted within the fresh food chamber 306. Melt water may, when allowed to by the male connector 302, flow through the male connector, from the male connector to the female connector, and through the female connector.

In exemplary embodiments, as illustrated in FIGS. 4 through 6 and 9, male connector 302 may include a casing 310 and a check valve 312. Check valve 312 may include a housing 314 and a valve stem 316. The check valve 312, such as the valve stem 316 thereof, may be movable between a closed position (as shown for example in FIG. 6) wherein melt water is prevented from flowing past the valve stem 316 and an open position (as shown for example in FIG. 5) wherein melt water is allowed to flow past the valve stem 316. Female connector 304 may include a receiver cup 318 which may interact with the check valve 312. For example, when the door 128 is in the closed position, the check valve 312, such as the valve stem 316 thereof, may contact the receiver cup 318, as illustrated in FIG. 5. This contact may bias the valve stem 316 into an open position, such that melt water can flow through the check valve 312 and the male connector 302 generally. When the door 128 is in the open position, the check valve 312, such as the valve stem 316 thereof, may no longer contact the receiver cup 318, as illustrated in FIG. 6. Since there is no contact, a spring 317 of the check valve 312 may bias the valve stem 316 into a closed position, such that melt water is prevented from flowing through the check valve 312 and the male connector 302 generally.

Figure 7:
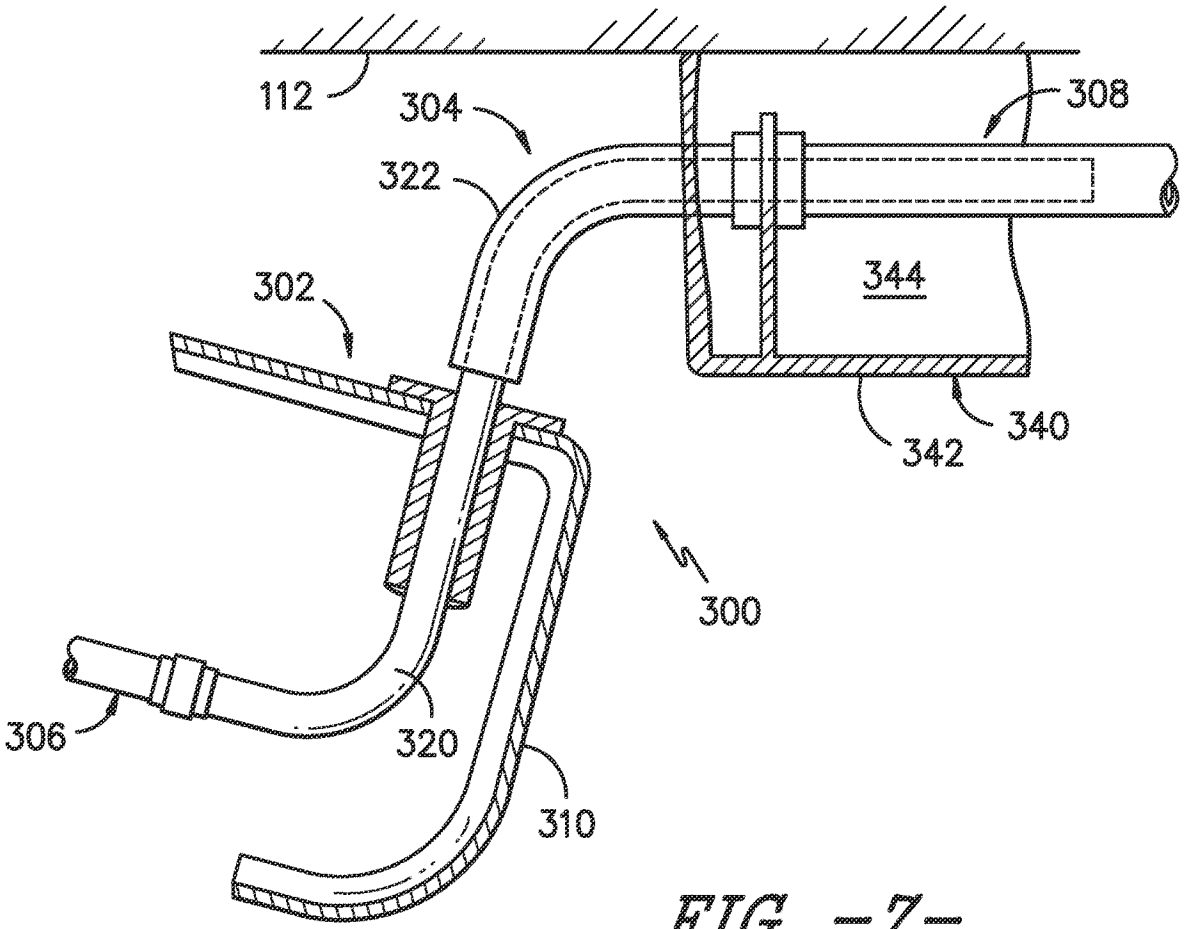
FIG. 7 is a top view of a drain assembly when a door is in a closed position in accordance with another embodiment of the present disclosure.
Figure 8:
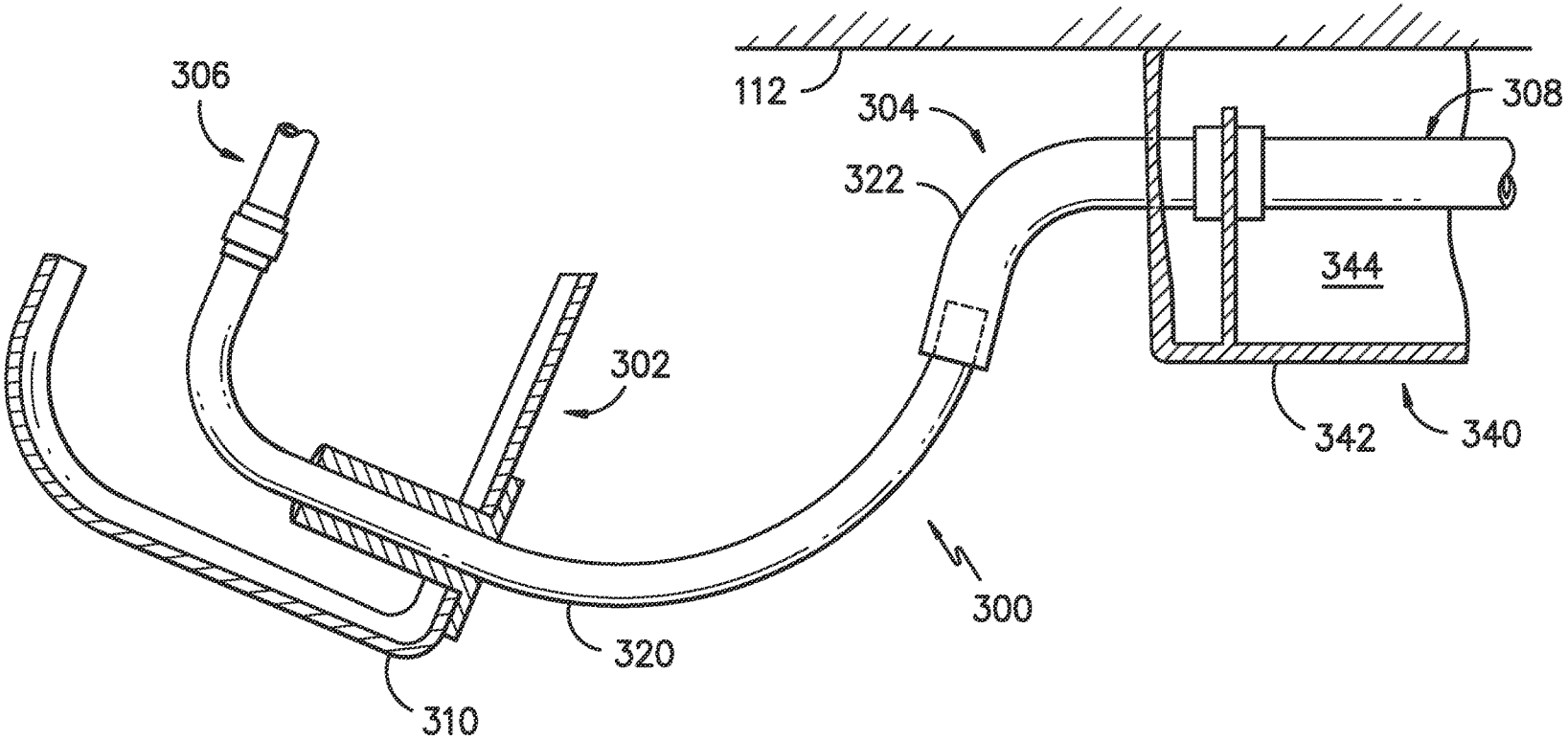
FIG. 8 is a top view of the drain assembly of FIG. 7 when a door is in an open position in accordance with another embodiment of the present disclosure.

In other embodiments, as illustrated in FIGS. 7 and 8, the male connector 302 may include a male tube 320 having a first cross-sectional area. In these embodiments, the female connector 304 may include a female tube 322 having a second cross-sectional area that is greater than the first cross-sectional area, such that the male tube 320 can fit within the female tube 322. A portion of the male tube 320 is disposed within the female tube 322. When the door 128 is in the closed position, as illustrated in FIG. 7, relatively more of the male tube 320 becomes disposed within the female tube 322. Melt water is thus allowed to flow from the male tube 320 to the female tube 322 when the door 128 is in the closed position. When the door 128 is in the open position, as illustrated in FIG. 8, relatively less of the male tube 320 becomes disposed within the female tube 322, but a portion of the male tube 320 does remain within the female tube 322. Melt water is thus allowed to flow from the male tube 320 to the female tube 322 when the door 128 is in the open position.

Notably, in embodiments as illustrated in FIGS. 7 and 8, the first duct 306 and male tube 320 may be separate components or may be integral with each other, and the second duct 306 and female tube 322 may be separate components or may be integral with each other.

It should be understood that the present disclosure is not limited to the above described embodiments, and rather that any suitable male and female connectors, which interact to allow the flow of melt water therethrough at least when an associated door 128 is in a closed position, are within the scope and spirit of the present disclosure.

As discussed, a first duct 306 may provide fluid communication between the container 220 and the male connector 302. For example, melt water may be allowed to flow from the container 220, such as through valve 240 and/or through reservoir 260. This melt water may flow into the first duct 306. For example, as shown, first duct 306 may be connected at one end to the reservoir 260. The melt water may flow through the first duct 306 into the male connector 302. As illustrated, first duct 306 or a portion thereof may be disposed within the door 128 (such as between the inner surface 132 and the outer surface 134). A substantial portion of the first duct 306 may, for example, be disposed within the door 128. The first duct 306 may extend generally along the vertical direction V between the container 220 and the male connector 302. A portion of the first duct 306 further may further be in communication with the male connector 302. For example, in the embodiments as illustrated in FIGS. 4 through 6 and 9, first duct 306 may extend into the casing 310 and connect to the check valve 312, such as to the housing 314 thereof. In other embodiments such as those illustrated in FIGS. 7 and 8, first duct 306 may for example extend into, surround, or be connected through for example a suitable fitting to male tube 320. Accordingly, melt water may flow through the first duct 306 to the male connector 302.

First duct 306 may in exemplary embodiments include one or more tube sections 330. Further, suitable fittings 332 may connect the tube sections 330 as required. Additionally, it should be noted that, in exemplary embodiments, a first conduit 334 may be disposed within the door 128 (such as between the inner surface 132 and the outer surface 134). The first conduit 334 may, for example, be defined or positioned in place within the door 128 by foam included in the door, and thus be "foamed in place" within the door 128. Portions of the first duct 306 may advantageously extend through the first conduit 334, and the first duct 306 may be movable within the first conduit 334.

As discussed, second duct 308 may provide fluid communication from the female connector 304, such as between the female connector 304 and an exhaust location. The exhaust location in exemplary embodiments may be the evaporator pan 280, which may for example be located below the cabinet 110 or within the cabinet 110 proximate the bottom 102 of the refrigerator appliance 100. Accordingly, melt water received by the female connector 304 may flow from the female connector 304 to and through the second duct 308, and from the second duct 308 to an exhaust location such as the evaporator pan 280.

As will be understood by those skilled in the art, evaporator pan 280 can also receive liquid runoff from an evaporator (not shown) of refrigerator appliance 100, e.g., during a defrost cycle of refrigerator appliance 100. However, in alternative exemplary embodiments, evaporator pan 280 can be a separate component such that the melt water and the evaporator of refrigerator appliance 100 are directed to separate pans. Further, in other alternative embodiments, the exhaust location need not be the evaporator pan 280, and rather may for example, be a drain of a plumbing system (not shown), e.g., within a residence housing refrigerator appliance 100, such that melt water is directed into the plumbing system rather than evaporating within evaporator pan 280 of refrigerator appliance 100.

Figure 9:
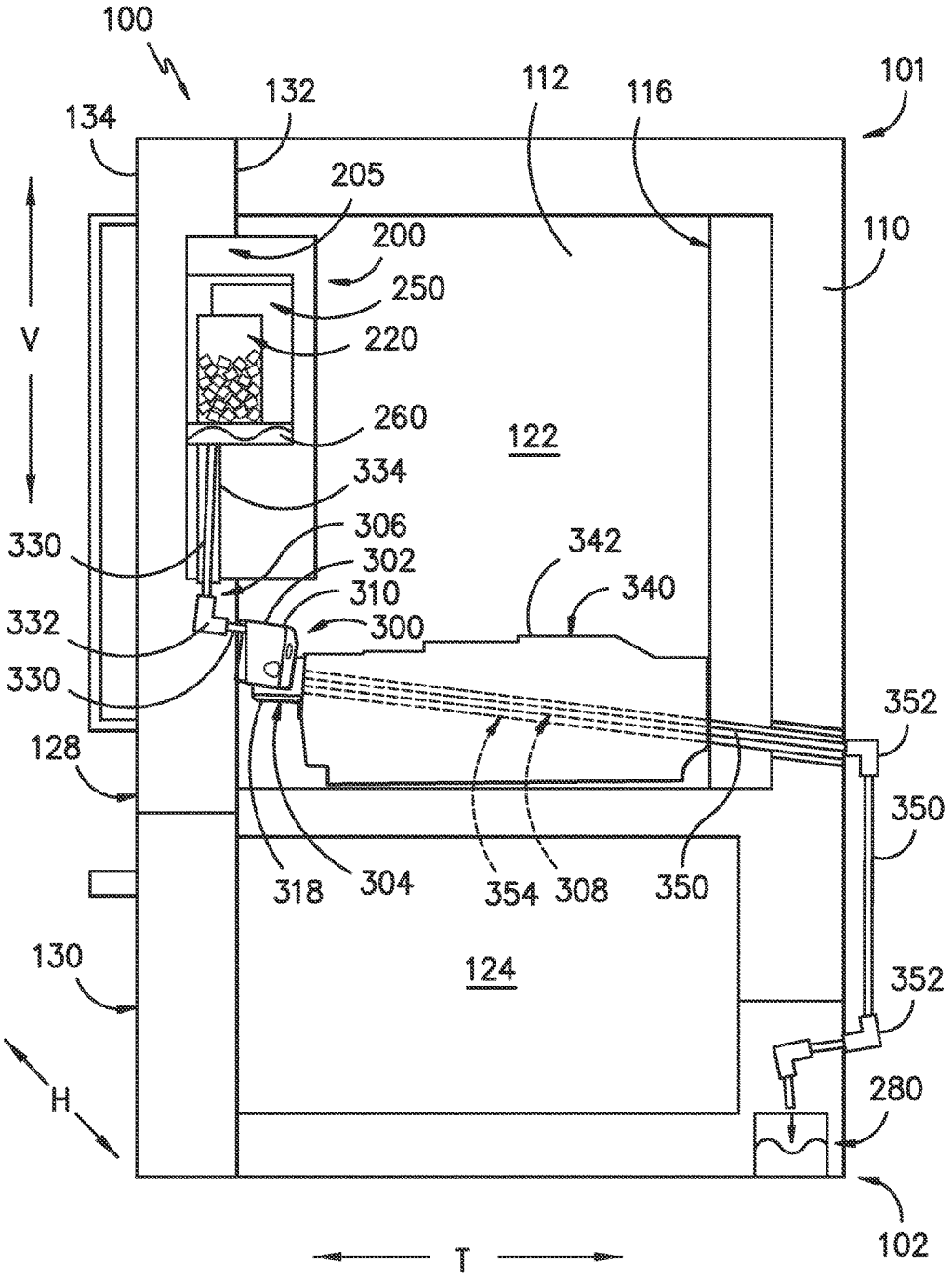
FIG. 9 is a side schematic view of an ice-maker assembly and drain assembly in a refrigerator appliance in accordance with one embodiment of the present disclosure.

As discussed, female connector 304 may be mounted within the fresh food chamber 122. In exemplary embodiments as illustrated in FIGS. 4 through 9, a shelf 340 may be disposed within the fresh food chamber 122. Shelf 340 may, for example, support a drawer 142 that is disposed within the fresh food chamber 122. Shelf 340 may include a body 342, and a shelf interior 344 may be defined between the body 342 and the wall to which the shelf is mounted, such as the first sidewall 112. In exemplary embodiments as shown, the female connector 304 may be mounted to the shelf 340. Further, in exemplary embodiments, the second duct 308 or a portion thereof may extend within the shelf interior 344. Still further, the second duct 308 may, as shown, extend from the fresh food chamber 122 to the exterior of the cabinet 110 through one of the walls defining the cabinet 110, such as the rear wall 116. As illustrated in FIG. 9, after extending through one of the walls, the second duct 308 may then extend to an exhaust location, such as to proximate the evaporator pan 280.

Second duct 308 may in exemplary embodiments include one or more tube sections 350. Further, suitable fittings 352 may connect the tube sections 350 as required. Additionally, it should be noted that, in exemplary embodiments, a second conduit 354 may be disposed within the fresh food chamber 122, such as at least partially within the shelf interior 344. Portions of the second duct 308 may advantageously extend through the second conduit 354, and the second duct 308 may be movable within the second conduit 354.

The present disclosure advantageously provides improved drainage for melt water within refrigerator appliances 100. The present drain assembly 300, for example, advantageously provides improved routing for melt water from an ice-maker assembly 200. Further, the present drain assembly 300 can easily and efficiently be retrofitted to existing refrigerator appliances 100 may simply replacing or modifying a door 128 of the refrigerator appliance 100, modifying a shelf 340 or other suitable mounting location within fresh food chamber 122, and adding one hole through cabinet 110 for downstream routing of the drain assembly 300. Still further, the present drain assembly 300 is advantageously a passive drain assembly, with no pumps or other active components required to facilitate the flow of melt water therethrough.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a fresh food chamber and a freezer chamber, the cabinet having a first sidewall and a second sidewall;

a shelf support positioned within the fresh food chamber along the first sidewall, the shelf support having a shelf interior that is defined by, and enclosed within, the shelf support and the first sidewall;

a door rotatably hinged to the cabinet for accessing the fresh food chamber, the door comprising an inner surface and an outer surface and rotatable between an open position and a closed position, the door further defining an ice box;

an ice maker disposed within the ice box;

a container defining a storage volume for receipt of ice produced by the ice maker; and a drain assembly for draining melt water from the container, the drain assembly comprising:

a male connector mounted to the door for flowing melt water therethrough;

a first duct providing fluid communication between the container and the male connector;

a female connector mounted within the fresh food chamber for flowing melt water therethrough from the male connector; and a second duct providing fluid communication from the female connector, wherein at least a portion of the second duct extends through the shelf interior between the shelf support and the first sidewall, wherein the male connector comprises a check valve comprising a housing and a valve stem, wherein the female connector comprises a receiver cup attached to the first sidewall, and wherein, in the closed position, the housing is received within the receiver cup.

2. The refrigerator appliance of claim 1, wherein the valve stem contacts the receiver cup when the door is in the closed position.

3. The refrigerator appliance of claim 1, wherein the male connector allows the flow of melt water therethrough when the door is in the closed position and prevents the flow of melt water therethrough when the door is in the open position.

4. The refrigerator appliance of claim 1, wherein the male connector comprises a male tube having a first cross-sectional area and the female connector comprises a female tube having a second cross-sectional area greater than the first cross-sectional area, and wherein a portion of the male tube is disposed within the female tube.

5. The refrigerator appliance of claim 1, wherein the male connector allows the flow of melt water therethrough when the door is in the closed position and the open position.

6. The refrigerator appliance of claim 1, wherein the cabinet further comprises a rear wall, wherein the first sidewall, second sidewall and rear wall defining the fresh food chamber and the freezer chamber.

7. The refrigerator appliance of claim 6, wherein the second duct extends through the rear wall.

8. The refrigerator appliance of claim 1, wherein the female connector is mounted to the shelf support.

9. The refrigerator appliance of claim 1, further comprising an evaporator pan, and wherein the second duct provides fluid communication between the female connector and the evaporator pan.

10. The refrigerator appliance of claim 1, further comprising a valve mounted to the container, the valve configured for selective adjustment between an open position in which the valve allows a flow of melt water from the storage volume of the container and a closed position in which the valve prevents the flow of melt water from the storage volume of the container, the valve configured for shifting between the open and closed position when the container is removed from and inserted into the ice box.

11. The refrigerator appliance of claim 10, wherein the valve is in the open position when the container is positioned within the ice box and the valve is in the closed position when the container is positioned outside of the ice box.

12. The refrigerator appliance of claim 1, wherein ice within the storage volume of the container is maintained at a temperature greater than about thirty-two degrees Fahrenheit.

13. The refrigerator appliance of claim 1, wherein the fresh food chamber is disposed above the freezer chamber along a vertical direction.

14. A refrigerator appliance, comprising:

a cabinet defining a fresh food chamber and a freezer chamber; the cabinet having a first sidewall and a second sidewall;

a shelf positioned within the fresh food chamber along the first sidewall, the shelf having a body forming a shelf interior that is defined by, and fully enclosed within, the body and the first sidewall;

a door rotatably hinged to the cabinet for accessing the fresh food chamber, the door comprising an inner surface and an outer surface and rotatable between an open position and a closed position, the door further defining an ice box;

an ice maker disposed within the ice box;

a container defining a storage volume for receipt of ice produced by the ice maker, the container removably positioned within the ice box;

an evaporator pan; and a drain assembly for draining melt water from the container, the drain assembly comprising:

a check valve mounted to the door for flowing melt water therethrough;

a first duct providing fluid communication between the container and the check valve;

a receiver cup mounted within the fresh food chamber for flowing melt water therethrough from the check valve;

a second duct providing fluid communication between the receiver cup and the evaporator pan, wherein at least a portion of the second duct extends through the shelf interior between the body of the shelf and the first sidewall; and wherein the check valve allows the flow of melt water therethrough when the door is in the closed position and prevents the flow of melt water therethrough when the door is in the open position, wherein the check valve comprises a housing and a valve stem, wherein the cup is attached to the first sidewall, and wherein, in the closed position, the housing is received within the receiver cup.

15. The refrigerator appliance of claim 14, wherein the cabinet further comprises a rear wall, and wherein the first sidewall, second sidewall and the rear wall define the fresh food chamber and the freezer chamber.

16. The refrigerator appliance of claim 15, wherein the female connector is mounted to the shelf.

17. The refrigerator appliance of claim 15, wherein the second duct is mounted on the shelf.

18. The refrigerator appliance of claim 15, wherein the second duct extends through the rear wall.

* * * * *